US010124507B2

(12) United States Patent
Zhu et al.

(10) Patent No.: US 10,124,507 B2
(45) Date of Patent: Nov. 13, 2018

(54) COLLAPSIBLE LOG SPLITTING ASSEMBLY WITH SAFETY PERIMETER

(71) Applicant: Zake IP Holdings, LLC, South Bend, IN (US)

(72) Inventors: Jianqing Zhu, Granger, IN (US); Benjamin Paul McGrew, South Bend, IN (US)

( * ) Notice: Subject to any disclaimer, the term of this patent is extended or adjusted under 35 U.S.C. 154(b) by 90 days.

(21) Appl. No.: 15/430,381

(22) Filed: Feb. 10, 2017

(65) Prior Publication Data

US 2018/0229395 A1 Aug. 16, 2018

(51) Int. Cl.
*B27L 7/06* (2006.01)

(52) U.S. Cl.
CPC ..... *B27L 7/06* (2013.01)

(58) Field of Classification Search
CPC .... B27L 7/00; B27L 7/005; B27L 7/06; B27L 7/08

See application file for complete search history.

(56) References Cited

U.S. PATENT DOCUMENTS 4,377,190 A * 3/1983 Pierrat ..... B27L 7/00 144/195.1
4,830,070 A * 5/1989 Nunnery ..... B27B 5/228 144/195.1
5,535,795 A * 7/1996 Bunn ..... B27L 7/005 144/195.4
2016/0107330 A1* 4/2016 Hutchinson ..... B27L 7/06 225/81

* cited by examiner

*Primary Examiner* — Matthew G Katcoff
(74) *Attorney, Agent, or Firm* — Tommy SF Wang; Wang IP Law Group, P.C.

(57) ABSTRACT

A collapsible log splitting assembly with safety perimeter splits a log with a parabolic-shaped blade, a blade housing having a plurality of ridges for separating the split log further, and a perimeter barrier for retaining the log upright while splitting, and protecting an operator from contact with blade. The assembly has an upright disposition that is pivotally collapsible into a planar configuration when not in use. The assembly has a base that is for support on a surface. The base includes a pair of brackets. A pair of sleeves pivotally join with the brackets, pivoting about the brackets. A pair of shafts slide within sleeves, sliding between operational and collapsed positions. A cutting apparatus comprises a blade housing that houses a parabolic blade, and extends between the shafts. Ridges along the base housing separate the log into smaller components. The perimeter barrier detachably attaches to top end of the shafts.

20 Claims, 7 Drawing Sheets

300

302

304

306

308

310

312

314

COLLAPSIBLE LOG SPLITTING ASSEMBLY WITH SAFETY PERIMETER

FIELD OF THE INVENTION

The present invention relates generally to a collapsible log splitting assembly with safety perimeter. More so, the present invention relates to a collapsible log splitting assembly that splits a log with a blade having a parabolic-shaped cross section, and a blade housing having ridges that separate and organize portions of the split log; and that further includes a safety perimeter for maintaining the log within a predetermined circumferential area of the assembly while splitting, and for preventing inadvertent contact with the blade; and further the assembly pivotally assembles into an operational position, and collapses into a generally flat configuration for stowage.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

It is known in the art that hand splitting of logs is a tedious, back breaking job. It is also costly and time consuming to any business which finds it necessary to split logs as a step or part of a manufacturing operation, or in the production of an end item, such as firewood. Further, hand loading of a log onto a log splitter can be a difficult task for larger log. It is desirable to have some assistance with this loading of the log into the log splitter.

Typically, wood splitting mechanisms operate by driving a wedge into a log either by pushing the log onto the wedge, or by forcing a wedge into a log. Many conventional kinetic log splitters force a stationary rack onto a moving pinion which is hard on both the machine and the operator pushing down on the rack.

One problem from the current power devices is the fact that the log being split can become stuck on the wedge. When the log is stuck on the wedge, a substantial amount of hand work can be required to loosen the log. Also some of the prior art devices have semi-circular bases which cause excess log splitting forces when logs wedge against the semi-circular log holder. The prior art devices teach that the holding mechanism must position the log properly. The design of these holding mechanisms limit the size of the logs to be split.

Other proposals have involved log splitting mechanisms. The problem with these splitting mechanisms is that they do not provide a blade that is dimensioned to optimize cutting efficiency. Also, the log does not have a surface to rest on for orienting before driving into the log for splitting. There are also safety concerns, since the operator is fully exposed to the blade and flying debris from the log as it is being split. Even though the above cited splitting mechanisms meet some of the needs of the market, a collapsible log splitting assembly with safety perimeter splits a log with a parabolic-shaped blade, a blade housing having a plurality of ridges for separating the split log further, and a perimeter barrier for retaining the log upright while splitting, and protecting an operator from contact with blade is still desired.

SUMMARY

Illustrative embodiments of the disclosure are generally directed to a collapsible log splitting assembly with safety perimeter. The collapsible log splitting assembly serves to split a log, kindling, or general workpiece through use of a unique blade having a parabolic-shaped cross section, and a blade housing having a plurality of ridges that work to further separate the split log. The assembly further comprises a safety perimeter barrier that forms around a predetermined periphery of the assembly. The perimeter barrier serves to: retain the log in an upright position, inhibit the log from being forcefully displaced from the circumferential area of the assembly while splitting, and protect an operator from inadvertent contact with the blade. Additionally, the assembly has a generally upright disposition when in an operational position, which is pivotally collapsible into a planar, collapsed position when not in use.

In some embodiments, the assembly has a base that provides a foundation on a ground surface. The base is configured to absorb an external force that splits the log. The base includes a pair of brackets disposed on opposite ends of the base. A pair of sleeves pivotally join with the brackets, such that the sleeves pivot about the brackets. The sleeves are defined by an elongated cavity terminating at a bottom edge and a top edge.

The assembly further comprises a pair of shafts defined by a top end and a bottom end. The shafts work to provide vertical integrity to the assembly when splitting the log. The shafts are positioned, at least in part, within sleeves. The shafts slide in both directions in the sleeves due in part to the shafts having an exterior cross sectional length sized to correspond with an interior cross sectional length of the sleeves. The shafts also pivot inside their respective sleeves.

The shafts also slide and pivot to articulate the assembly into an operational position. In the operational position, the shafts are disposed generally perpendicular with the base by sliding the shafts through the sleeves until the bottom end of the shafts is flush with the bottom edge of the sleeves. Then, the shafts pivot vertically, or until perpendicular with the base. The shafts are then operational to support a perimeter barrier, as described below In some embodiments, the assembly may further comprise a locking mechanism that operatively connects to the pair of sleeves and the pair of brackets. The locking mechanism is configured to regulate pivoting by the pair of sleeves about the pair of brackets, and also to regulate the sliding of the shafts through the sleeves. Thus, the locking mechanism may be used to fixedly retain the shafts in the operational position, and generally regulate pivoting by the pair of shafts about the pair of brackets.

Conversely, the shafts may be pivoted into collapsed position that is coplanar with the base for stowage by pivoting the shafts until horizontal with the base, and then sliding the shafts through the sleeves until the ends of the shaft are equidistant from the corresponding edges of the sleeves. The locking mechanism may be released to enable the shafts to pivot back to the collapsed position.

In some embodiments, a cutting apparatus extends between the shafts for engaging and splitting the log. The cutting apparatus is defined by a blade housing that houses a blade. The blade is defined by a generally parabolic-shaped cross section. The blade orients upwardly, away from the base, to enable splitting of the log. An external force, such as a sledgehammer, drives the log into the blade. The parabolic shape of the blade enhances the splitting capacity of the blade. A plurality of ridges along the base housing work to separate the split log into smaller components, such as kindling and shards, so as to organize the split log.

The assembly further utilizes a perimeter barrier that serves as a safety perimeter to protect the operator and assist in positioning of the log for optimal splitting thereof. A perimeter barrier detachably attaches to the top ends of the shafts, in a generally perpendicular disposition when in the operational mode. In one embodiment, a pair of legs extend from opposite ends of the perimeter barrier to couple to the respective top ends of the shafts.

The perimeter barrier helps to retain the log in an upright position before it is driven into the blade with the external force. The perimeter barrier also inhibits body parts from inadvertently engaging the blade, or receiving the force from the log being driven into the blade, or preventing the log from being forced out of the frame from the force of the sledgehammer. The perimeter barrier detaches from the pair of shafts when the assembly is in the collapsed position. The perimeter barrier attaches to the pair of shafts when the assembly is in the operational position.

In operation, the top end of a log can be leaned against the perimeter barrier while the bottom end of the log is aligned onto the blade for splitting at a desired position. A sledgehammer (not a part of the invention) applies an external force to drive the log into the blade. The perimeter barrier forms an outer barrier that helps to prevent the log from being forced out of the frame from the force of the sledgehammer.

One objective of the present invention is to provide a collapsible log splitting assembly that is pivotally assembled upright for operation, and collapsed flat for stowage.

Another objective is to provide a pair of sleeves that pivot, so as to enable the shafts to pivotally assembly and collapse.

Yet another objective is to provide a parabolic-shaped blade for enhanced splitting of the log.

Yet another objective is to provide ridges on the blade housing to separate the split log into finer portions.

Yet another objective is to enhance safety and log splitting efficiency with a detachable perimeter barrier that forms a predetermined circumferential area around the top end of the shafts.

Yet another objective is to provide a perimeter barrier to protect the operator from inadvertent contact with the blade.

Yet another objective is to provide an inexpensive to manufacture collapsible log splitting assembly.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A collapsible log splitting assembly 100 with safety perimeter is referenced in FIGS. 1-9G. The collapsible log splitting assembly 100, hereafter "assembly 100", is configured to enable an operator to drive a log 200, kindling, or general workpiece into a parabolic-shaped blade 126 and a plurality of ridges 128 for purposes of splitting the log 200 into smaller portions, while maintaining a safety perimeter around the assembly 100 for stable retention of the log 200 in an upright position, and general safety of the operator.

Figure 1:
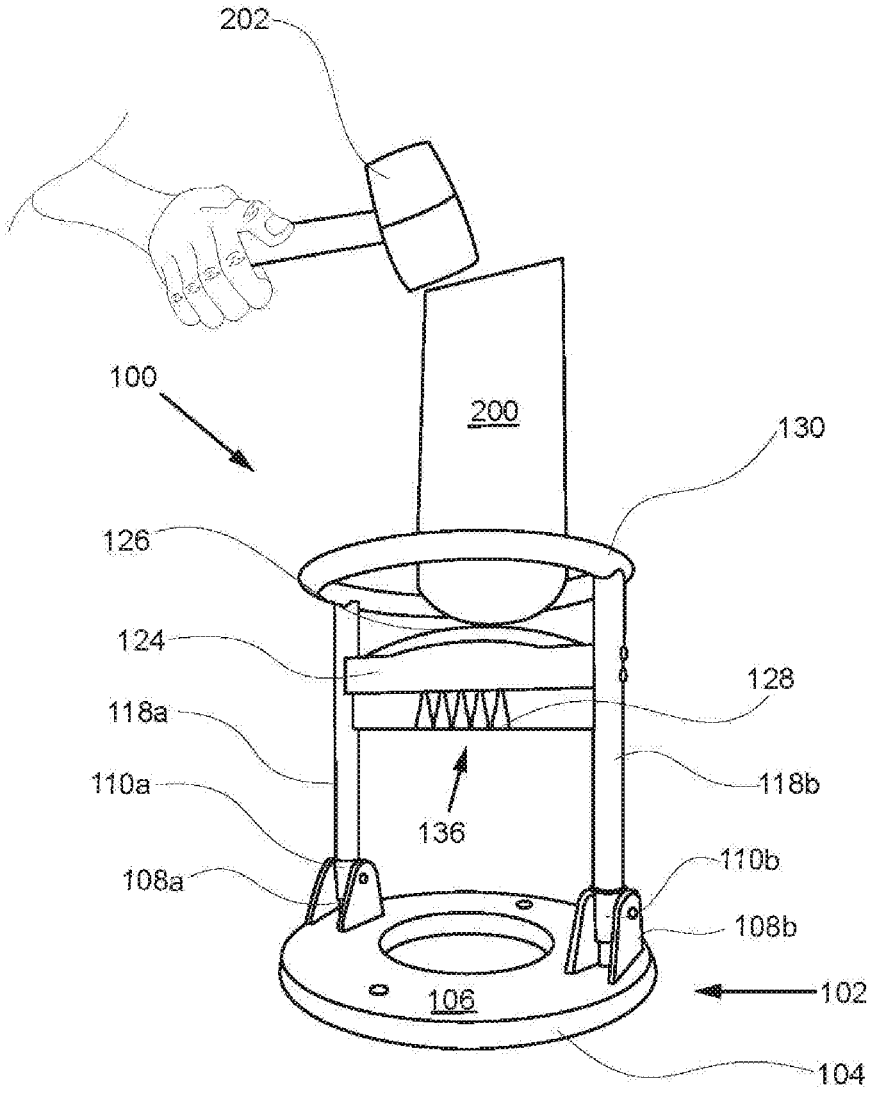
FIG. 1 illustrates a perspective view of an exemplary collapsible log splitting assembly with safety perimeter in operation splitting a log, in accordance with an embodiment of the present invention.

As illustrated in the illustration of FIG. 1, the assembly 100 may be especially effective in splitting the log 200 through use of a unique blade 126 having a parabolic-shaped cross section that splits the log 200 with minimal drag on the log 200, and a blade housing 124 having a plurality of ridges 128 that work to further separate the split log 200 into smaller, more organized portions.

The assembly 100 further comprises a perimeter barrier 130 that forms around a predetermined periphery of the assembly 100. The perimeter barrier 130 serves to: 1) retain the log 200 in an upright position; 2) inhibit the log 200 from being forcefully displaced from the circumferential area of the assembly 100 while splitting; and 3) protect an operator from inadvertent contact with the blade 126. Additionally, the assembly 100 has a generally upright disposition when in an operational position 140, which is pivotally collapsible into a planar, collapsed position 142 when not in use.

Figure 2:
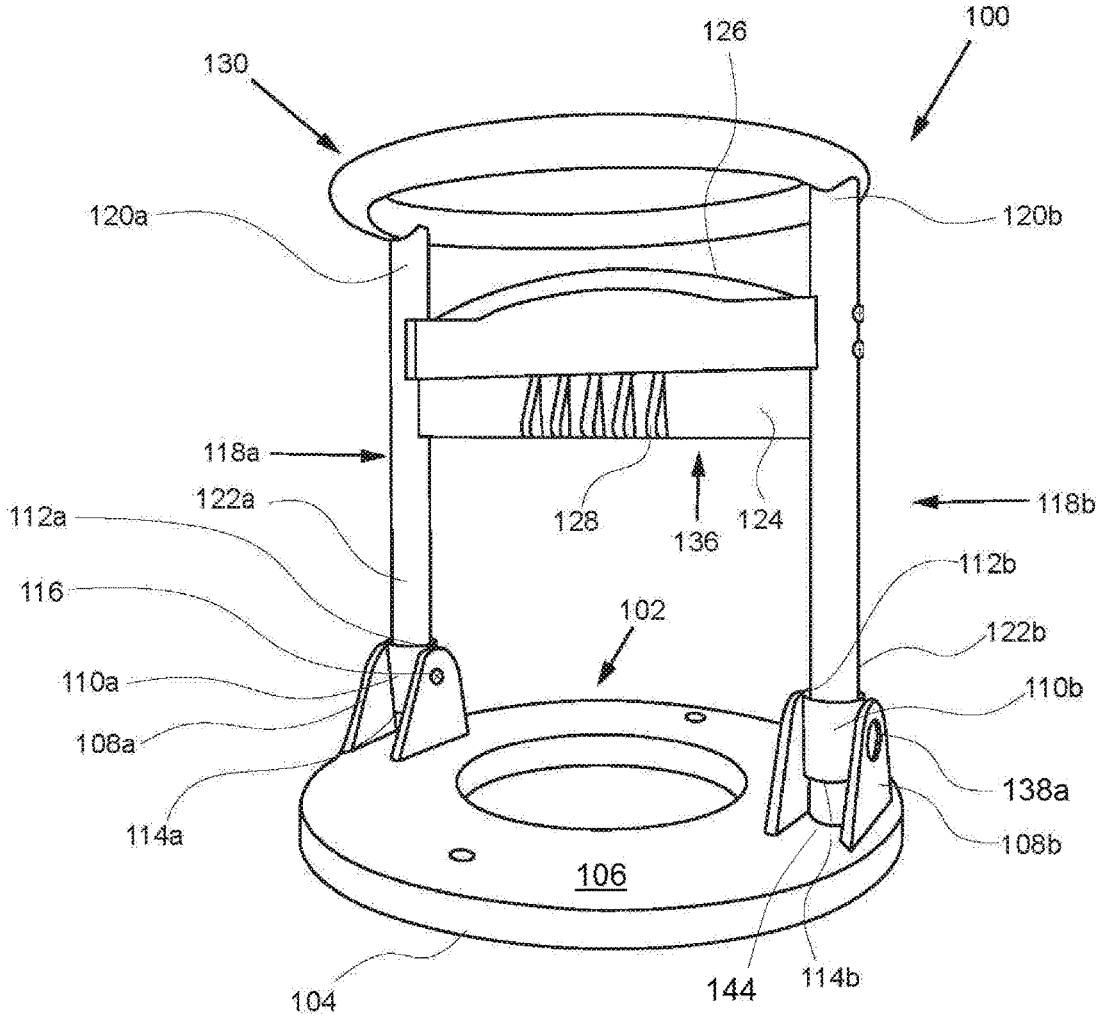
FIG. 2 illustrates a front perspective view of a collapsible log splitting assembly, in accordance with an embodiment of the present invention.

As shown in FIG. 2, the assembly 100 provides a base 102, which serves as the foundational support for the assembly 100. The base 102 is defined by a generally flat surface 106 and a perimeter 104 that may be rounded or sharp. In some embodiments, the base 102 may include a generally circular, flat configuration. Though in other embodiments, the base 102 may be square, rectangular, triangular, or oval in shape.

The base 102 forms the foundation for the assembly 100 on a flat, stable ground surface, so as to enable efficient splitting of the log 200. In one embodiment, the surface 106 of the base 102 is defined by two bolt holes that enable anchoring, for enhanced stability of the assembly 100. In one exemplary use, the base 102 is configured to absorb an external force, such as from a sledgehammer 202 that drives into, and splits the log 200 into multiple portions. Suitable materials for the base 102 may include, without limitation, aluminum, iron, a metal alloy, a rigid polymer, fiberglass, and wood.

The base 102 includes a pair of brackets 108*a*, 108*b* disposed on opposite ends of the perimeter 104 of the base 102. The brackets 108*a*, 108*b* may have a generally triangular shape and serve to enable hinging or pivoting about an axle 116 that traverses the brackets 108*a*, 108*b*. Suitable materials for the brackets 108*a*, 108*b* may include, without limitation, aluminum, iron, a metal alloy, a rigid polymer, and wood. It is significant to note that a suitably hard wood coupled with a minor design modifications would enable wooden brackets and shafts to function adequately. Such a wooden configuration with appropriate reinforcement might allow for a buoyant device suitable for large watercraft, wherein firewood may be desired, but swinging an axe may not be appropriate.

Figure 3:
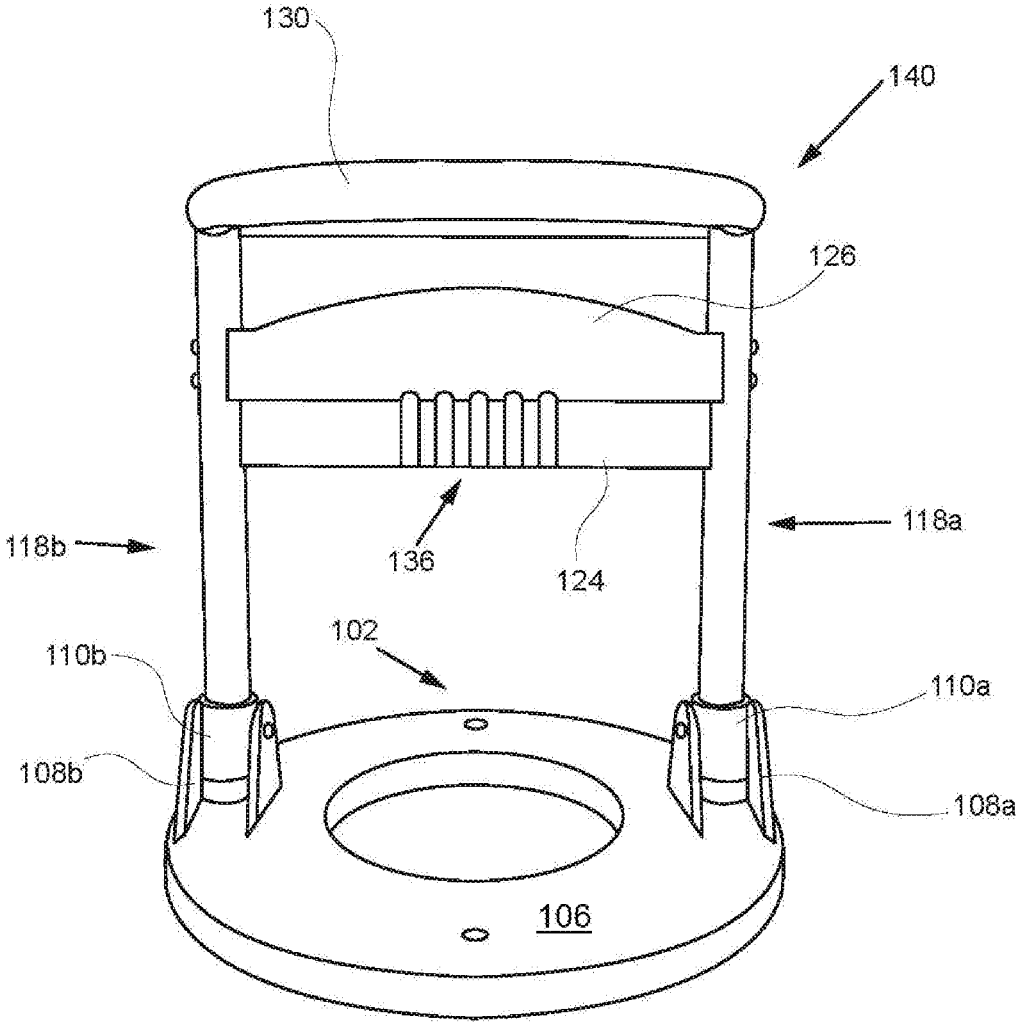
FIG. 3 illustrates a rear perspective view of the collapsible log splitting assembly shown in FIG. 2 disposed in an operational position, in accordance with an embodiment of the present invention.

Turning now to FIG. 3, the assembly 100 provides a pair of sleeves 110*a*, 110*b* that pivotally join with the brackets 108*a*, 108*b*. The sleeves 110*a*, 110*b* are defined by an elongated cavity terminating at a bottom edge 114*a*, 114*b* and a top edge 112*a*, 112*b*. The sleeves 110*a*, 110*b* pivotally join with the pair of brackets 108*a*, 108*b*, such that the sleeves 110*a*, 110*b* pivot about the brackets 108*a*, 108*b*. In one embodiment, the sleeves 110*a*, 110*b* pivot up to 180°. The sleeves 110*a*, 110*b* may be cylindrical in shape.

Figure 6:
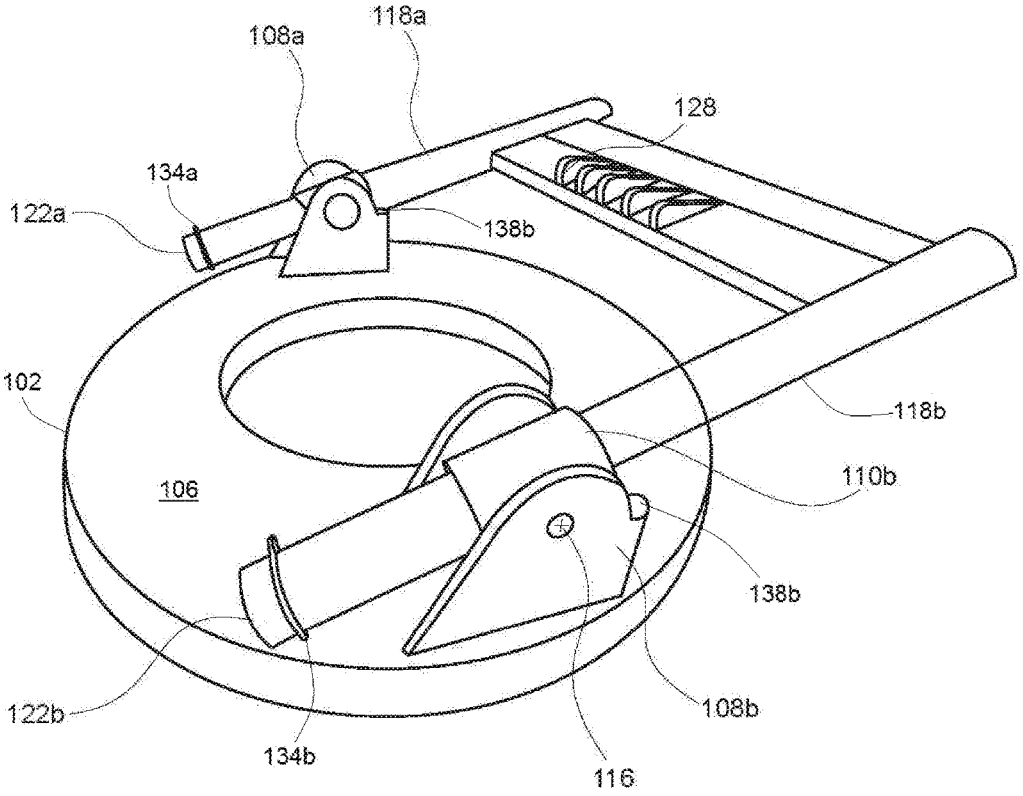
FIG. 6 illustrates a close up view of an exemplary bracket pivotally joined by a pair of sleeves and a pair of shafts, in accordance with an embodiment of the present invention.

Looking ahead to FIG. 6, the assembly 100 further comprises a pair of shafts 118*a*, 118*b* defined by a top end 120*a*, 120*b* and a bottom end 122*a*, 122*b*. The shafts 118*a*, 118*b* work to provide vertical integrity to the assembly 100 when splitting the log 200. In some embodiments, the shafts 118*a*, 118*b* are rigid, and generally longer than the sleeves 110*a*, 110*b*. In one embodiment, the shafts 118*a*, 118*b* are less than 11" long.

In some embodiments, a depression 144 forms in the base 102 within the brackets. The shafts 118*a*, 118*b* are nested in the depression 144 when in the operational configuration to increase stability and prevent rotation of the shafts. The shafts 118*a*, 118*b* in the depression 144 may constitute a locking mechanism, but between the base 102 and shafts 118*a*, 118*b*, rather than between the sleeves 110*a*, 110*b* and the brackets 108*a*, 108*b*.

Suitable materials for the shafts 118*a*, 118*b* may include, without limitation, aluminum, steel, a metal alloy, a rigid polymer, and wood. It is significant to note that a suitably hard wood coupled with a minor design modifications would enable wooden brackets and shafts to function adequately. Such a wooden configuration with appropriate reinforcement might allow for a buoyant device suitable for large watercraft, wherein firewood may be desired, but swinging an axe may not be appropriate.

The shafts 118*a*, 118*b* are positioned, at least in part, within sleeves 110*a*, 110*b*. The shafts 118*a*, 118*b* slide in both directions in the sleeves 110*a*, 110*b* due in part to the shafts 118*a*, 118*b* having an exterior cross sectional length sized to correspond with an interior cross sectional length of the sleeves 110*a*, 110*b*.

The shafts 118*a*, 118*b* also slide and pivot to articulate the assembly 100 into an operational position 140. In the operational position 140, the shafts 118*a*, 118*b* can by articulated to a generally perpendicular orientation with the base 102 by sliding the shafts 118*a*, 118*b* through the sleeves 110*a*, 110*b* until the bottom end 122*a*, 122*b* of the shafts 118*a*, 118*b* is flush with the bottom edge 114*a*, 114*b* of the sleeves 110*a*, 110*b*. Then, the shafts 118*a*, 118*b* pivot vertically, or until perpendicular with the base 102. From this operational position 140, the shafts 118*a*, 118*b* can support a perimeter barrier 130, as described below. Further, the bottom end 122*a*, 122*b* of the shafts 118*a*, 118*b* may include at least one C-ring 134*a*, 134*b* that inhibits the pair of shafts 118*a*, 118*b* from sliding through the sleeves 110*a*, 110*b*.

In some embodiments, the assembly 100 may further comprise at least one locking mechanism 138*a*, 138*b* that operatively connects to the pair of sleeves 110*a*, 110*b* and the pair of brackets 108*a*, 108*b*. The locking mechanism 138*a*, 138*b* is configured to regulate pivoting by the pair of sleeves 110*a*, 110*b* about the pair of brackets 108*a*, 108*b*, and also to regulate the slidable displacement of the shafts 118*a*, 118*b* through the sleeves 110*a*, 110*b*. Thus, the locking mechanism 138*a*, 138*b* may be used to fixedly retain the shafts 118*a*, 118*b* in the operational position 140, and generally regulate pivoting by the pair of shafts 118*a*, 118*b* about the pair of brackets 108*a*, 108*b*.

In one embodiment, the at least one locking mechanism 138*b* is a divet, or ridge that serves as a barrier to inhibit the sleeve, and the attached shaft from pivoting beyond a 90° relative to the base 102. In another embodiment, the locking mechanism 138*a* may include a torsion spring that restricts pivoting by the shafts 118*a*, 118*b* past a predetermined angle. Though any mechanism that mechanically restricts pivoting by the shafts may be used. Further, as described below, a depression 144 that forms in the base 102 also serves as a secondary locking means.

Figure 4:
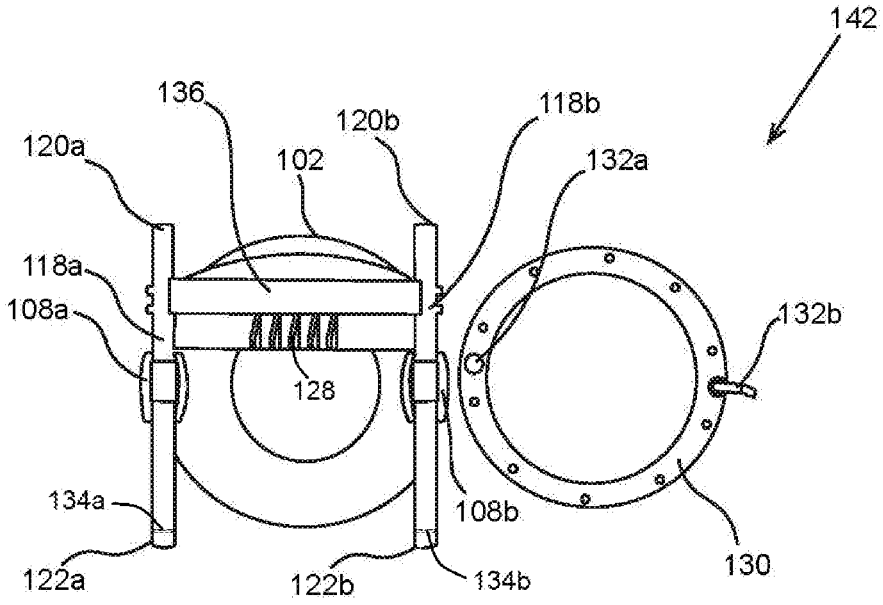
FIG. 4 illustrates a top view of the collapsible log splitting assembly shown in FIG. 2 disposed in a collapsed position and with the perimeter barrier removed, in accordance with an embodiment of the present invention.

As illustrated in FIG. 4, the shafts 118*a*, 118*b* may also be slid and pivoted to achieve a collapsed position 142, in which the assembly 100 may be stowed or transported more easily. In the collapsed position 142, the shafts 118*a*, 118*b* are disposed generally horizontal with the base 102, and the perimeter barrier 130 is removed from the top end 120*a*, 120*b* of the shafts 118*a*, 118*b*, as described below.

Figure 5:
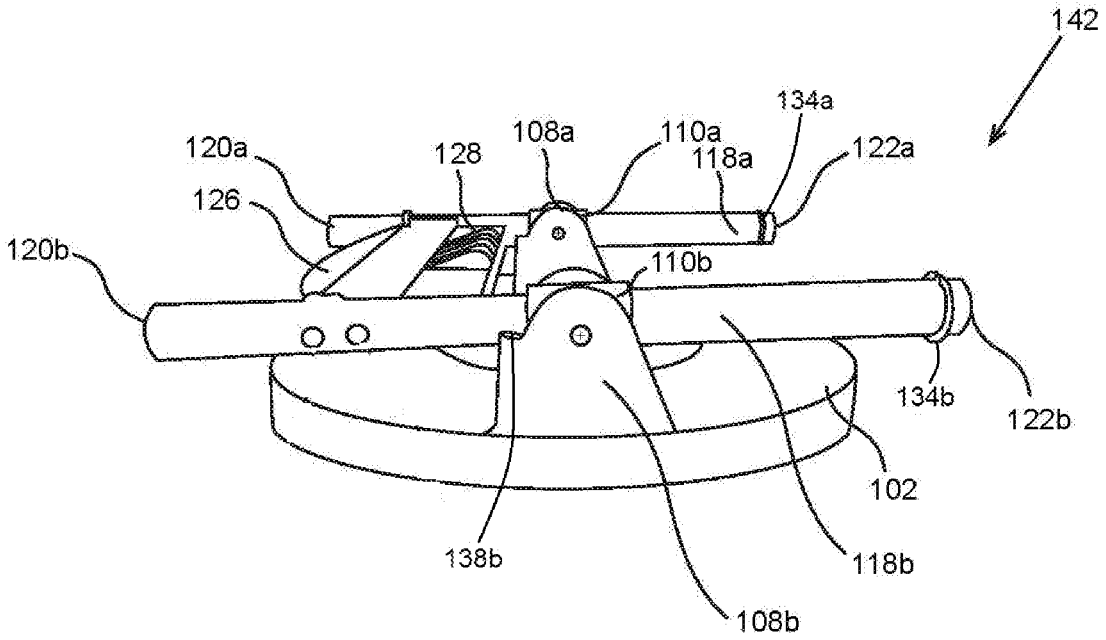
FIG. 5 illustrates an elevated side view of the collapsible log splitting assembly shown in FIG. 2 disposed in a collapsed position, in accordance with an embodiment of the present invention.

To achieve the collapsed position 142, the shafts 118*a*, 118*b* are pivoted until parallel with the base 102. The shafts 118*a*, 118*b* are then slid through the sleeves 110*a*, 110*b* until the ends of the shafts 118*a*, 118*b* are equidistant from the corresponding edges of the sleeves 110*a*, 110*b* (FIG. 5). It is significant to note that, if the locking mechanism 138*a*, 138*b* is utilized, the locking mechanism 138*a*, 138*b* may be released to enable the shafts 118*a*, 118*b* to pivot back to the collapsed position 142.

Figure 7:
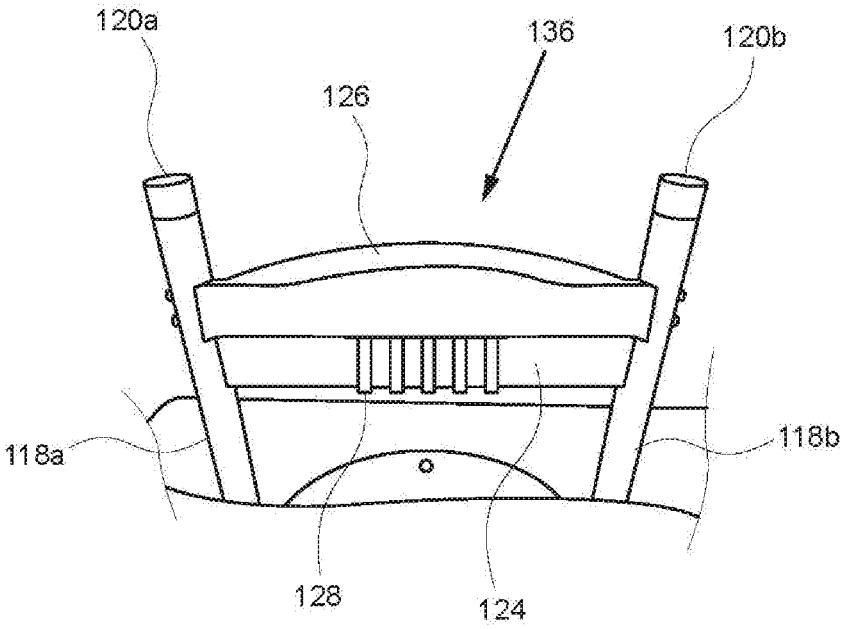
FIG. 7 illustrates a close up view of an exemplary cutting apparatus, in accordance with an embodiment of the present invention.

As illustrated in FIG. 7, the assembly 100 further comprises a cutting apparatus 136 for engaging the log 200 to split into large portions, and further to separate the split portions into yet smaller portions. The cutting apparatus 136 extends between the shafts 118*a*, 118*b* in a generally perpendicular orientation. In one embodiment, the cutting apparatus is disposed more proximal to the top end of the shafts 118*a*, 118*b*.

The cutting apparatus 136 is defined by a blade housing 124 that houses a blade 126. The blade housing 124 may include a pair of panels that enclose the blade 126 form opposite sides. The blade 126 is defined by a generally parabolic-shaped cross section, and configured to efficiently cut through wood, and other medium. In some embodiments, the blade 126 may be specially constructed to cut through metal or stone.

The blade 126 orients upwardly, away from the base 102, to enable splitting of the log 200. An external force, such as that exerted by a sledgehammer 202, drives the log 200 into the blade 126. The parabolic shape of the blade 126 enhances the splitting capacity of the blade 126. Specifically, the unique curvature and mid-section tapering of the parabolic-shaped blade 126 is configured to create less resistance as the log 200 is split across the length of the blade 126. This results in a smoother, sharper and more energetic splitting of the log 200. The shape of the blade 126 serves primarily to localize the force of the impact. In one embodiment, the blade 126 may be formed along an edge between two faces having an included angle between them of approximately 60° or less. Though in other embodiments, other dimensions for the blade 126 may be used.

At least one ridge is disposed along the blade housing 124. The at least one ridge 128 works to separate the split log 200 into smaller components, such as kindling and shards, so as to organize the split log 200. Specifically, the ridges serve the purpose of physically forcing the wood apart after the initial cut has been made. The at least one ridge 128 does not have to be a plurality of discreet ridges, and could instead be a single solid wedge occupying an equivalent space.

For example, as the log 200 is split into two portions across the blade 126, the split sections slide along the surface of the blade housing 124, engaging the ridges 128. The ridges 128 separate the split log 200, kindling, and shards of wood into smaller, more organized portions. In some embodiments, the ridges 128 may include spaced-apart, elongated protrusions that extend across the blade housing 124.

Figure 8:
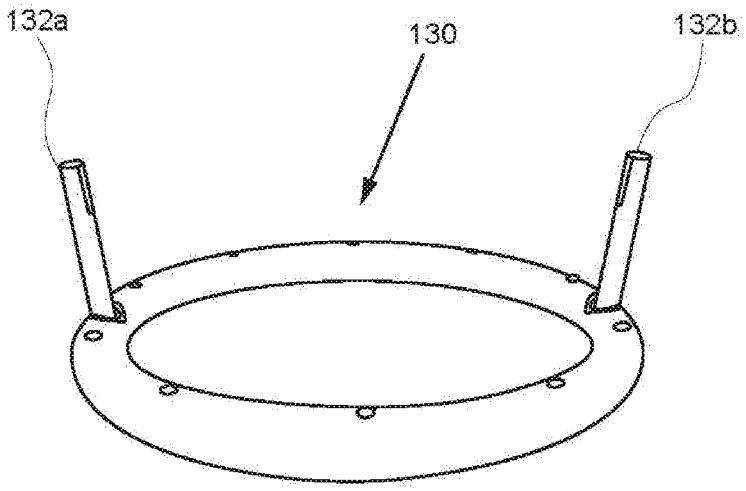
FIG. 8 illustrates a close up view of an exemplary perimeter barrier, in accordance with an embodiment of the present invention.
Figure 9A:
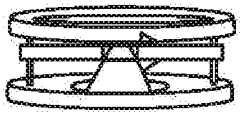
FIGS. 9A, 9B, 9C, 9D, 9E, 9F, and 9G illustrate the steps in articulating the assembly from the collapsed position with the perimeter barrier attached parallel to the base, to the operational position, in accordance with an embodiment of the present invention.
Figure 9B:
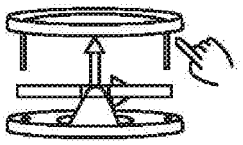
Figure 9C:
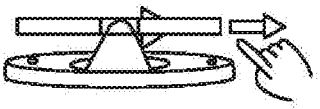
Figure 9D:
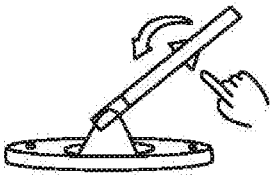
Figure 9E:
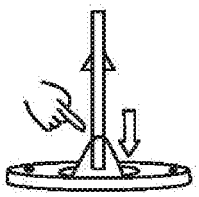
Figure 9F:
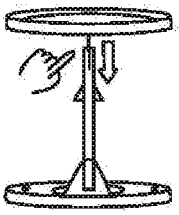
Figure 9G:
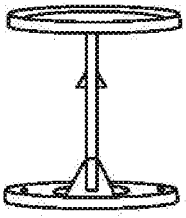

As shown in FIG. 8, the assembly 100 further comprises a perimeter barrier 130. The perimeter barrier 130 serves as a safety perimeter to protect the operator and assist in positioning of the log 200 for optimal splitting thereof. The perimeter barrier 130 detachably attaches to the top end 120*a*, 120*bs* of the shafts 118*a*, 118*b*, in a generally perpendicular disposition when in the operational position 140. In one embodiment, a pair of legs 132*a*, 132*b* extend from opposite ends of the perimeter barrier 130 to couple to the respective top end 120*a*, 120*bs* of the shafts 118*a*, 118*b*. In one embodiment, the perimeter barrier 130 is a ring. Though other shapes may be used. In another embodiment, the perimeter barrier 130 has an 8" diameter.

The perimeter barrier 130 helps to retain the log 200 in an upright position before it is driven into the blade 126 with the external force. The perimeter barrier 130 also inhibits body parts from inadvertently engaging the blade 126, or receiving the force from the log 200 being driven into the blade 126, or preventing the log 200 from being forced out of the frame from the force of the sledgehammer.

The perimeter barrier 130 detaches from the pair of shafts 118*a*, 118*b* when the assembly 100 is in the collapsed position 142. The perimeter barrier 130 attaches to the pair of shafts 118*a*, 118*b* when the assembly 100 is in the operational position 140. In one embodiment, a pair of legs 132*a*, 132*b* extend from opposite ends of the perimeter barrier 130. The legs 132*a*, 132*b* detachably couple to the top end 120*a*, 120*b* of the shafts 118*a*, 118*b*.

FIGS. 9A, 9B, 9C, 9D, 9E, 9F, and 9G illustrate a process 300 comprising multiple steps 302-314 for articulating the assembly 100 from the collapsed position 142 to the operational position 140. It is known that reversing these Steps enables the assembly 100 to be articulated back to the collapsed position 142 for stowage. In an initial Step 302, the assembly 100 is initially removed from packaging material. The assembly 100 is in the collapsed position when being unpacked. The shafts 118*a*, 118*b* are parallel with the base 102 and are configured to detachably attach to the base when collapsed 142 to secure the cutting assembly during stowage or transportation. It is significant to note that the perimeter barrier 130 is attached and parallel to the base 102 in FIG. 9A when in the collapsed position 142. However, FIG. 4 illustrates the assembly 100 in the collapsed position 142 without a perimeter barrier 130 attached thereto, but rather detached and separate from the rest of the assembly 100.

In some embodiments, a Step 304, the perimeter barrier 130 is detached from the top end 120*a*, 120*b* of the shafts 118*a*, 118*b*. A Step 306 may include sliding the pair of shafts 118*a*, 118*b* through the pair of sleeves 110*a*, 110*b* until the bottom end 122*a*, 122*b* of the pair of shafts 118*a*, 118*b* is substantially aligned with the bottom edge 114*a*, 114*b* of the pair of sleeves 110*a*, 110*b*. A Step 308 may include pivoting the pair of shafts 118*a*, 118*b* generally perpendicular to the base 102. A Step 310 includes pushing the shafts 118*a*, 118*b* firmly against the base 102 to establish a stable vertical position for the shafts 118*a*, 118*b*. A Step 312 comprises coupling the perimeter barrier 130 to the top end 120*a*, 120*b* of the shafts 118*a*, 118*b*. A final Step 314 comprises placing the assembly 100 on a flat surface and commencing with the splitting of the log 200.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A splitting assembly, the assembly comprising:

a base defined by a surface and a perimeter, the base configured to support the assembly;

a pair of brackets disposed on opposite ends of the perimeter of the base;

a pair of sleeves comprising a top edge and a bottom edge, the pair of sleeves configured to pivotally join with the pair of brackets, whereby the pair of sleeves pivot about the pair of brackets;

a pair of shafts comprising a top end and a bottom end, the pair of shafts configured to pass through the pair of sleeves, whereby the assembly articulates to an operational position by sliding the pair of shafts through the pair of sleeves until the bottom end of the pair of shafts is substantially aligned with the bottom edge of the pair of sleeves, and pivoting the pair of shafts generally perpendicular to the base, whereby the assembly articulates to a collapsed position by pivoting the pair of shafts generally horizontal with the base, and sliding the pair of shafts through the pair of sleeves until the top end and the bottom end of the pair of shafts are generally equidistant from the corresponding top edge and bottom edge of the pair of sleeves;

a cutting apparatus having:

a blade defined by a generally parabolic shape, and a blade housing configured to at least partially house the blade, the blade housing comprising at least one ridge; and a perimeter barrier configured to detachably attach to the top end of the pair of shafts, whereby the perimeter barrier detaches from the pair of shafts when the assembly is in the collapsed position, whereby the perimeter barrier attaches to the pair of shafts when the assembly is in the operational position.

2. The assembly of claim 1, wherein the base has a generally flat, round shape.

3. The assembly of claim 1, wherein the pair of shafts are less than 11 inches long.

4. The assembly of claim 1, wherein the pair of sleeves are shorter than the pair of shafts.

5. The assembly of claim 1, further comprising an axle configured to enable the pair of sleeves to rotate about the pair of brackets.

6. The assembly of claim 1, wherein the blade is oriented towards the top end of the pair of shafts.

7. The assembly of claim 1, wherein the at least one ridge is multiple ridges disposed in a spaced-apart relationship along the length of the blade housing.

8. The assembly of claim 1, wherein the perimeter barrier is a rigid ring.

9. The assembly of claim 1, wherein the perimeter barrier has an eight inch inner diameter, and a 9.5 inch outer diameter.

10. The assembly of claim 1, wherein the perimeter barrier comprises a pair of legs configured to detachably attach the perimeter barrier to the top end of the pair of shafts.

11. The assembly of claim 1, further comprising at least one C-ring at the bottom end of the pair of shafts, the at least one C-ring configured to at least partially inhibit the pair of shafts from sliding through the pair of sleeves.

12. The assembly of claim 1, further comprising at least one locking mechanism, the at least one locking mechanism configured to regulate pivoting by the pair of sleeves about the pair of brackets.

13. The assembly of claim 1, wherein the base forms a depression configured to support the pair of shaft.

14. A splitting assembly, the assembly consisting of:

a base defined by a surface and a perimeter, the surface forming a depression, the base configured to support the assembly;

a pair of brackets disposed on opposite ends of the perimeter of the base;

a pair of sleeves comprising a top edge and a bottom edge, the pair of sleeves configured to pivotally join with the pair of brackets, whereby the pair of sleeves pivot about the pair of brackets;

an axle configured to enable the pair of sleeves rotate about the pair of brackets;

a pair of shafts comprising a top end and a bottom end, the pair of shafts configured to pass through the pair of sleeves, whereby the assembly articulates to an operational position by sliding the pair of shafts through the pair of sleeves until the bottom end of the pair of shafts is substantially aligned with the bottom edge of the pair of sleeves, and pivoting the pair of shafts generally perpendicular to the base, whereby the assembly articulates to a collapsed position by pivoting the pair of shafts generally parallel with the base, and sliding the pair of shafts through the pair of sleeves until the top end and the bottom end of the pair of shafts are generally equidistant from the corresponding top edge and bottom edge of the pair of sleeves;

at least one C-ring configured to at least partially inhibit the pair of shafts from sliding through the pair of sleeves;

at least one locking mechanism operatively connected to the pair of sleeves and the pair of brackets, the at least one locking mechanism configured to restrict pivoting by the pair of shafts;

a cutting apparatus having:

a blade defined by a generally parabolic shape, the blade disposed to orient towards the top end of the pair of shafts, and a blade housing configured to at least partially house the blade, the blade housing comprising at least one ridge;

a perimeter barrier configured to detachably attach to the top end of the pair of shafts, the perimeter barrier comprising a generally annular shape, whereby the perimeter barrier detaches from the pair of shafts when the assembly is in the collapsed position, whereby the perimeter barrier attaches to the pair of shafts when the assembly is in the operational position; and a pair of legs configured to detachably attach the perimeter barrier to the top end of the pair of shafts.

15. The assembly of claim 14, wherein the blade is oriented towards the top end of the pair of shafts.

16. The assembly of claim 14, wherein the at least one ridge is a plurality of spaced-apart ridges along the length of the blade housing.

17. The assembly of claim 14, wherein the locking mechanism is configured to regulate pivoting by the pair of sleeves about the pair of brackets.

18. The assembly of claim 14, wherein the locking mechanism comprises a torsion spring or a divet in the pair of brackets.

19. The assembly of claim 14, wherein the depression is configured to help support the pair of shafts.

20. The assembly of claim 14, wherein the pair of shafts are less than 11 inches long.

* * * * *